US007959329B2

(12) United States Patent
Van De Ven

(10) Patent No.: US 7,959,329 B2
(45) Date of Patent: Jun. 14, 2011

(54) LIGHTING DEVICES, LIGHTING ASSEMBLIES, FIXTURES AND METHOD OF USING SAME

(75) Inventor: Antony Paul Van De Ven, Hong Kong SAR (CN)

(73) Assignee: Cree, Inc., Durham, NC (US)

( * ) Notice: Subject to any disclaimer, the term of this patent is extended or adjusted under 35 U.S.C. 154(b) by 652 days.

(21) Appl. No.: 11/856,421

(22) Filed: Sep. 17, 2007

(65) Prior Publication Data

US 2008/0084700 A1 Apr. 10, 2008

Related U.S. Application Data

(60) Provisional application No. 60/845,429, filed on Sep. 18, 2006.

(51) Int. Cl.
*F21V 29/00* (2006.01)

(52) U.S. Cl. ..... 362/373; 362/218; 362/294; 362/438; 362/444; 362/650

(58) Field of Classification Search ..... 362/218, 362/294, 373, 438, 444, 650
See application file for complete search history.

(56) References Cited

U.S. PATENT DOCUMENTS

| | | | | | |
|---|---|---|---|---|---|
| 1,565,500 | A | | 12/1925 | Ritter | |
| 3,052,749 | A | | 9/1962 | Milton et al. | |
| 3,263,023 | A | | 7/1966 | Staley | |
| 3,541,492 | A | * | 11/1970 | Fenn | 439/239 |
| 4,163,277 | A | | 7/1979 | Altman | |
| 4,219,871 | A | | 8/1980 | Larrimore | |
| 4,685,037 | A | * | 8/1987 | Akiyama et al. | 362/276 |
| 4,689,442 | A | | 8/1987 | Ozaki | |
| 4,780,799 | A | * | 10/1988 | Groh | 362/294 |
| 5,116,689 | A | | 5/1992 | Castro et al. | |
| 5,219,221 | A | * | 6/1993 | Yamaka et al. | 362/294 |
| 5,458,505 | A | * | 10/1995 | Prager | 439/485 |
| 5,537,301 | A | | 7/1996 | Martich | |
| 5,697,696 | A | | 12/1997 | Kuroda et al. | |
| 5,876,831 | A | | 3/1999 | Rawal | |

(Continued)

FOREIGN PATENT DOCUMENTS

FR 2 263 458 10/1975

(Continued)

OTHER PUBLICATIONS

Cree, Inc., "Cree® Xlamp® 7090 XR-E Series LED Binning and Labeling," Application Note: CLD-AP08.000, 7pp (2006).

(Continued)

*Primary Examiner* — Stephen F Husar
*Assistant Examiner* — James W Cranson
(74) *Attorney, Agent, or Firm* — Burr & Brown

(57) ABSTRACT

Lighting devices which comprise a connector portion, a light emitter, a casing and a heat transfer component. At least a first portion of the heat transfer component which is in contact with the casing is spaced farther from an axis of the connector portion than a second portion of the heat transfer component. Also, fixtures comprising a housing, a socket and at least one heat transfer component. Also, lighting assemblies comprising a housing, a socket, a heat transfer component and a lighting device which comprises a light emitter and a casing, respective portions of the heat transfer component being in contact with the casing and with the housing. Also, lighting devices comprising means for transferring heat, and methods of deploying lighting devices.

28 Claims, 3 Drawing Sheets

U.S. PATENT DOCUMENTS

| | | | | |
|---|---|---|---|---|
| 6,045,240 | A | 4/2000 | Hochstein | |
| 6,278,607 | B1 | 8/2001 | Moore et al. | |
| 6,441,943 | B1 | 8/2002 | Roberts et al. | |
| 6,482,520 | B1 | 11/2002 | Tzeng | |
| 6,659,632 | B2 | 12/2003 | Chen | |
| 6,740,972 | B2 | 5/2004 | Smith et al. | |
| 6,788,541 | B1 | 9/2004 | Hsiung | |
| 6,789,921 | B1 | 9/2004 | Deloy et al. | |
| 6,791,257 | B1 | 9/2004 | Sato et al. | |
| 6,800,932 | B2 | 10/2004 | Lam et al. | |
| 6,805,474 | B2 | 10/2004 | Walser et al. | |
| 6,864,573 | B2 | 3/2005 | Robertson et al. | |
| 6,880,954 | B2 | 4/2005 | Ollett et al. | |
| 6,896,392 | B2 * | 5/2005 | Jigamian et al. | 362/202 |
| 6,949,772 | B2 | 9/2005 | Shimizu et al. | |
| 7,030,486 | B1 | 4/2006 | Marshall | |
| 7,095,110 | B2 | 8/2006 | Arik et al. | |
| 7,121,688 | B2 | 10/2006 | Rempel | |
| 7,144,140 | B2 | 12/2006 | Sun et al. | |
| 7,210,832 | B2 * | 5/2007 | Huang | 362/547 |
| 7,213,940 | B1 | 5/2007 | Van De Ven et al. | |
| 7,226,189 | B2 | 6/2007 | Lee et al. | |
| 7,234,844 | B2 | 6/2007 | Bolta et al. | |
| 7,258,475 | B2 | 8/2007 | Kurumatani | |
| 7,284,874 | B2 | 10/2007 | Jeong et al. | |
| 2004/0105247 | A1 | 6/2004 | Calvin et al. | |
| 2005/0051789 | A1 | 3/2005 | Negley et al. | |
| 2005/0077525 | A1 | 4/2005 | Lynch et al. | |
| 2005/0092469 | A1 | 5/2005 | Huang | |
| 2005/0094105 | A1 | 5/2005 | Otsuka et al. | |
| 2005/0128751 | A1 | 6/2005 | Robarge et al. | |
| 2005/0174780 | A1 | 8/2005 | Park | |
| 2005/0237739 | A1 | 10/2005 | Lee et al. | |
| 2006/0061539 | A1 | 3/2006 | Song et al. | |
| 2006/0098440 | A1 | 5/2006 | Allen | |
| 2006/0187660 | A1 | 8/2006 | Liu | |
| 2007/0074755 | A1 | 4/2007 | Eberspacher et al. | |

FOREIGN PATENT DOCUMENTS

| | | |
|---|---|---|
| GB | 1 494 493 | 12/1977 |
| JP | 09-055457 | 2/1997 |
| JP | 11-264668 | 9/1999 |
| WO | 2008079161 | 7/2004 |

OTHER PUBLICATIONS

Cree, Inc., "Cree® Xlamp® 7090 XR-E Series LED Data Sheet," Datasheet: CLD-DS05.000, 10 pp (2006).
Cree, Inc., "Cree® Xlamp® 7090 XR-E Series LED Secondary Optics," Datasheet: CLD-DS07.000, 3 pp (2004-2006).
McMaster-Carr Supply Company, "Multipurpose Aluminum (Alloy 6061), specification sheets," Retrieved Dec. 14, 2006 from www.mcmaster.com/param/asp/Psearch2.asp?regTyp=parametric &act=psearch%F.., 3 pp.
U.S. Appl. No. 11/614,180, filed Dec. 21, 2006.
U.S. Appl. No. 11/613,714, filed Dec. 20, 2006.
U.S. Appl. No. 11/613,733, filed Dec. 20, 2006.
U.S. Appl. No. 11/624,811, filed Jan. 19, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/736,761, filed Apr. 18, 2007.
U.S. Appl. No. 11/736,799, filed Apr. 18, 2007.
U.S. Appl. No. 11/737,321, filed Apr. 19, 2007.
U.S. Appl. No. 11/936,163, filed Nov. 7, 2007.
U.S. Appl. No. 11/843,243, filed Aug. 22, 2007.
U.S. Appl. No. 11/948,021, filed Nov. 30, 2007.
U.S. Appl. No. 11/870,679, filed Oct. 11, 2007.
U.S. Appl. No. 11/951,626, filed Dec. 6, 2007.
U.S. Appl. No. 12/035,604, filed Feb. 22, 2008.
U.S. Appl. No. 11/673,951, filed Feb. 12, 2007.
U.S. Appl. No. 11/379,709, filed Apr. 21, 2006.
U.S. Appl. No. 11/379,726, filed Apr. 21, 2006.
U.S. Appl. No. 11/408,767, filed Apr. 21, 2006.

* cited by examiner

LIGHTING DEVICES, LIGHTING ASSEMBLIES, FIXTURES AND METHOD OF USING SAME

CROSS-REFERENCE TO RELATED APPLICATIONS

This application claims the benefit of U.S. Provisional Patent Application No. 60/845,429, filed Sep. 18, 2006, the entirety of which is incorporated herein by reference.

FIELD OF THE INVENTION

The present invention relates to lighting devices, lighting assemblies, lighting fixtures and methods of using them, in particular lighting devices, lighting assemblies, lighting fixtures which can be used to provide excellent heat dissipation, and methods of using such items. In one aspect, the present invention relates to solid state lighting devices, in particular, devices which include solid state light emitters and which provide for improved heat dissipation.

BACKGROUND OF THE INVENTION

A large proportion (some estimates are as high as twenty-five percent) of the electricity generated in the United States each year goes to lighting. Accordingly, there is an ongoing need to provide lighting which is more energy-efficient.

Efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, efficacy (lm/W), and/or duration of service.

A variety of solid state light emitters are well-known. For example, one type of solid state light emitter is a light emitting diode.

Light emitting diodes are semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present invention can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, a wide variety of lighting devices, in particular LEDs, do not operate as reliably at elevated temperatures as they do at lower temperatures. In the case of LEDs, heatsinking is often provided so that the heat generated by the LED junction is dissipated into the ambient air to keep the junction temperature of the LED low—typically, a junction temperature of 75 degrees C. is a desirable maximum. Such a requirement, however, puts a severe constraint on the amount of power that can be provided to the LEDs while dissipating enough heat to satisfy the temperature requirement, which often means that LED-containing light bulbs are dull when compared to incandescent and fluorescent counterparts.

BRIEF SUMMARY OF THE INVENTION

LEDs generate light very efficiently, but LEDs generally cannot operate reliably at elevated temperature. Heatsinking must be provided so that the heat generated by the LED junction is dissipated into the ambient air to keep the junction temperature of the LED low. Typically a junction temperature of 75 degrees C. is a desirable maximum. This requirement puts severe constraints as to how much power can be applied to the LED, and generally means that the LED light bulbs are dull when compared to their standard counterparts such as incandescent and fluorescent.

Incandescent light bulbs use filaments that operate at very high temperature (many hundreds of degrees C.) enclosed within a glass envelope. These bulbs are generally positioned within light fixtures so that the bulb does not come into contact with the fixture.

According to the present invention, there are provided devices which include at least one heat transfer component which, when in operation, is connected to and/or in contact with both the lighting device and the housing, such that it conducts heat away from the lighting device to the housing.

In accordance with a first aspect according to the present invention, there is provided a lighting device, comprising:

a connector portion, at least a portion of which is electrically conductive;

at least a first light emitter;

a casing which at least partially encloses the first light emitter;

at least one heat transfer component, at least a first portion of the heat transfer component being in contact with a first portion of the casing, the first portion of the casing being spaced from an axis of the connector portion by a first distance, at least a second portion of the heat transfer component being spaced from the axis of the connector portion by a second distance, the second distance being greater than the first distance.

In some embodiments according to the first aspect of the present invention, there is further provided at least a first contact, at least a portion of which is electrically conductive.

In accordance with a second aspect according to the present invention, there is provided a fixture for a lighting device, comprising:

a housing;

a socket, the housing supporting the socket;

at least one heat transfer component, at least a first portion of the heat transfer component being spaced from an axis of the socket by a first distance, at least a second portion of the heat transfer component being in contact with a first portion of the housing, the first portion of the housing being spaced from the axis of the socket by a second distance, the second distance being greater than the first distance.

In accordance with a third aspect according to the present invention, there is provided a lighting assembly, comprising:

a housing;

a socket, the housing supporting the socket;

at least one heat transfer component; and a lighting device comprising:

a connector portion, at least a portion of the connector portion being electrically conductive;

at least a first contact, at least a portion of the first contact being electrically conductive;

at least a first light emitter; and a casing, the casing at least partially enclosing the first light emitter, at least a first portion of the heat transfer component being attached to a first portion of the casing, the first portion of the casing being spaced from an axis of the connector portion by a first distance, at least a second portion of the heat transfer component being in contact with a first portion of the housing, the first portion of the housing being spaced from the axis of the connector portion by a second distance, the second distance being greater than the first distance.

In accordance with a fourth aspect according to the present invention, there is provided a lighting assembly, comprising:

a housing;

a socket, the housing supporting the socket;

at least one heat transfer component; and a lighting device comprising:

a connector portion, at least a portion of the connector portion being electrically conductive;

at least a first contact, at least a portion of the first contact being electrically conductive;

at least a first light emitter; and a casing, the casing at least partially enclosing the first light emitter, at least a first portion of the heat transfer component being in contact with a first portion of the casing, the first portion of the casing being spaced from an axis of the connector portion by a first distance, at least a second portion of the heat transfer component being attached to a first portion of the housing, the first portion of the housing being spaced from the axis of the connector portion by a second distance, the second distance being greater than the first distance.

In accordance with a fifth aspect according to the present invention, there is provided a lighting assembly, comprising:

a housing;

a socket, the housing supporting the socket;

at least one heat transfer component; and a lighting device comprising:

at least a first light emitter; and a casing, the casing at least partially enclosing the first light emitter, at least a first portion of the heat transfer component being in contact with a first portion of the casing, at least a second portion of the heat transfer component being in contact with a first portion of the housing.

In accordance with a sixth aspect according to the present invention, there is provided a method of deploying a lighting device, comprising:

connecting into a socket of a fixture a connector portion of a lighting device, the fixture comprising a housing, the lighting device comprising the connector portion, at least a first contact, at least a first light emitter, a casing, and at least one heat transfer component, at least a portion of the connector portion being electrically conductive, at least a portion of the first contact being electrically conductive, the casing at least partially enclosing the first light emitter, at least a first portion of the heat transfer component being in contact with a first portion of the casing, and then causing at least a second portion of the heat transfer component to move into contact with the housing.

In accordance with a seventh aspect according to the present invention, there is provided a method of deploying a lighting device, comprising:

connecting into a socket of a fixture a connector portion of a lighting device, the fixture comprising a housing and at least one heat transfer component, the lighting device comprising the connector portion, at least a first contact, at least a first light emitter and a casing, at least a portion of the connector portion being electrically conductive, at least a portion of the first contact being electrically conductive, the casing at least partially enclosing the first light emitter, at least a first portion of the heat transfer component being in contact with a the housing, and then causing at least a second portion of the heat transfer component to move into contact with the casing.

In accordance with an eighth aspect according to the present invention, there is provided a method of deploying a lighting device, comprising:

connecting into a socket of a fixture a connector portion of a lighting device, the fixture comprising a housing, the lighting device comprising the connector portion, at least a first contact, at least a first light emitter and a casing, at least a portion of the connector portion being electrically conductive, at least a portion of the first contact being electrically conductive, the casing at least partially enclosing the first light emitter, and then inserting a heat transfer component into the lighting device such that at least a first portion of the heat transfer component is in contact with a first portion of the casing and at least a second portion of the heat transfer component is in contact with the housing.

In accordance with a ninth aspect according to the present invention, there is provided a lighting device, comprising:

at least a first light emitter;

a casing which at least partially encloses the first light emitter;

at least one heat transfer component, at least a first portion of the heat transfer component being in contact with a first portion of the casing, at least a second portion of the heat transfer component being spaced from the casing.

In accordance with a tenth aspect according to the present invention, there is provided a. fixture for a lighting device, comprising:

a housing;

a socket, the housing supporting the socket;

at least one heat transfer component, at least a first portion of the heat transfer component being spaced from the housing, at least a second portion of the heat transfer component being in contact with a first portion of the housing.

In accordance with an eleventh aspect according to the present invention, there is provided a lighting assembly, comprising:

a housing;

a socket, the housing supporting the socket;

at least one heat transfer component; and a lighting device comprising:

at least a first light emitter; and a casing, the casing at least partially enclosing the first light emitter, at least a first portion of the heat transfer component being attached to a first portion of the casing, at least a second portion of the heat transfer component being in contact with a first portion of the housing.

In accordance with a twelfth aspect according to the present invention, there is provided a lighting assembly, comprising:

a housing;

a socket, the housing supporting the socket;

at least one heat transfer component; and a lighting device comprising:

at least a first light emitter; and a casing, the casing at least partially enclosing the first light emitter, at least a first portion of the heat transfer component being in contact with a first portion of the casing, at least a second portion of the heat transfer component being attached to a first portion of the housing.

In accordance with a thirteenth aspect according to the present invention, there is provided a method of deploying a lighting device, comprising:

positioning a socket-engaging portion of a lighting device in a socket of a fixture, the fixture comprising a housing, the lighting device comprising a casing and at least one heat transfer component, the casing at least partially enclosing the first light emitter, at least a first portion of the heat transfer component being in contact with a first portion of the casing, and then causing at least a second portion of the heat transfer component to move into contact with the housing.

In accordance with a fourteenth aspect according to the present invention, there is provided a method of deploying a lighting device, comprising:

positioning a socket-engaging portion of a lighting device in a socket of a fixture, the fixture comprising a housing and at least one heat transfer component, the lighting device comprising at least a first light emitter and a casing, the casing at least partially enclosing the first light emitter, at least a first portion of the heat transfer component being in contact with the housing, and then causing at least a second portion of the heat transfer component to move into contact with the casing.

In accordance with a fifteenth aspect according to the present invention, there is provided a method of deploying a lighting device, comprising:

positioning a socket-engaging portion of a lighting device in a socket of a fixture, the fixture comprising a housing, the lighting device comprising at least a first light emitter and a casing, the casing at least partially enclosing the first light emitter, and then inserting a heat transfer component into the lighting device such that at least a first portion of the heat transfer component is in contact with a first portion of the casing and at least a second portion of the heat transfer component is in contact with the housing.

The invention may be more fully understood with reference to the accompanying drawings and the following detailed description of the invention.

BRIEF DESCRIPTION OF THE DRAWING FIGURES

DETAILED DESCRIPTION OF THE INVENTION

Figure 1:
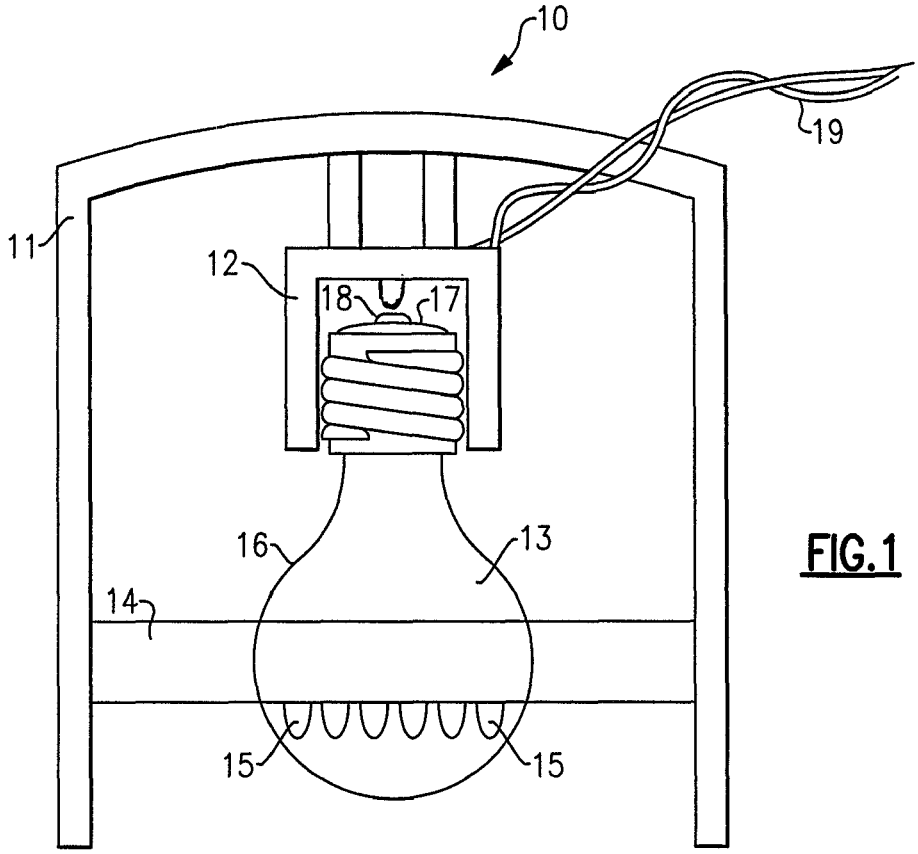
FIGS. 1-4 depict an embodiment of a lighting assembly according to the present invention.
Figure 2:
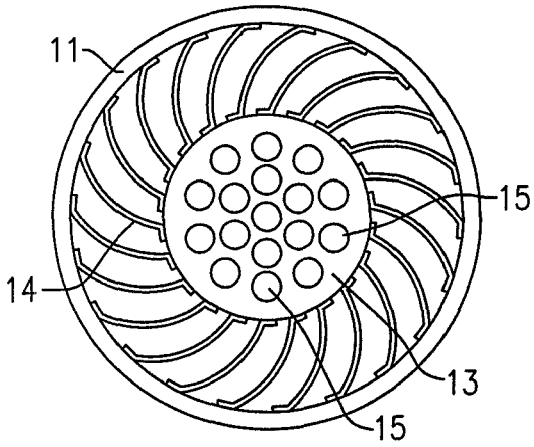
Figure 3:
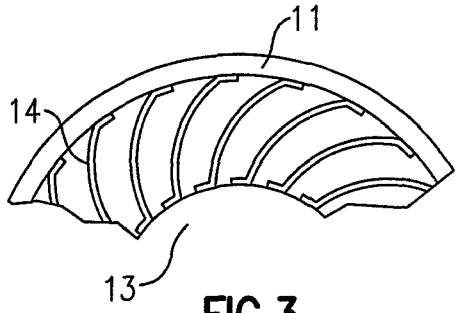

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments in accordance with the present invention are described herein with reference to cross-sectional (and/or plan view) illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

Some of the aspects of the present invention relate to lighting assemblies (and individual components of such lighting assemblies, e.g., lighting devices, and fixtures which include one or more components of such lighting assemblies), which lighting assemblies comprise (1) at least one lighting device, (2) at least one housing and (3) at least one heat transfer component, a first portion of which is in contact with (and/or attached to) a portion of the casing of the lighting device and a second portion of which is in contact with (and/or attached to) a portion of the housing, such that the heat transfer component increases the rate of heat transfer from the casing to the housing (relative to if no heat transfer component were provided).

In such embodiments, the (or each) lighting device comprises at least one light emitter and a casing. The light emitter can be any suitable light emitter, a wide variety of which are well-known and readily available to persons skilled in the art. For example, the light emitter can be a solid state light emitter, an incandescent light emitter or a fluorescent light emitter. The lighting assembly can include any number of light emitters—where there are more than one light emitter, the respective light emitters can be similar to one another, different from one another or any combination (i.e., there can be a plurality of light emitters of one type, or one or more light emitters of each of two or more types)

Solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made). The expression "solid state light emitter", as used herein, can refer to a component including one or more solid state light emitter or a component including one or more solid state light emitter as well as one or more lumiphor. In some embodiments according to the present invention, a lighting device includes one or more solid state light emitters which include at least one solid state light emitter and at least one lumiphor which emits light, at least a portion of such light emitted by the luminescent element being emitted in response to luminescent material in the luminescent element being excited by light emitted by the at least one solid state light emitter.

As noted above, one type of solid state light emitter which can be employed are LEDs. Such LEDs can be selected from among any light emitting diodes (a wide variety of which are readily obtainable and well known to those skilled in the art, and therefore it is not necessary to describe in detail such devices, and/or the materials out of which such devices are made). For instance, examples of types of light emitting diodes include inorganic and organic light emitting diodes, a variety of each of which are well-known in the art.

Representative examples of such LEDs, many of which are known in the art, can include lead frames, lumiphors, encapsulant regions, etc.

Representative examples of suitable LEDs are described in:

(1) U.S. Patent Application No. 60/753,138, filed on Dec. 22, 2005, entitled "Lighting Device" (inventor: Gerald H. Negley), the entirety of which is hereby incorporated by reference, and U.S. patent application Ser. No. 11/614,180, filed Dec. 21, 2006 (now U.S. Patent Publication No. 2007/0236911);

(2) U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven), the entirety of which is hereby incorporated by reference, and U.S. patent application Ser. No. 11/624,811, filed Jan. 19, 2007 (now U.S. Patent Publication No. 2007/0170447);

(3) U.S. Patent Application No. 60/808,702, filed on May 26, 2006, entitled "Lighting Device" (inventors: Gerald H. Negley and Antony Paul van de Ven), the entirety of which is hereby incorporated by reference, and U.S. patent application Ser. No. 11/751,982, filed May 22, 2007 (now U.S. Patent Publication No. 2007/0274080);

(4) U.S. Patent Application No. 60/808,925, filed on May 26, 2006, entitled "Solid State Light Emitting Device and Method of Making Same" (inventors: Gerald H. Negley and Neal Hunter), the entirety of which is hereby incorporated by reference, and U.S. patent application Ser. No. 11/753,103, filed May 24, 2007 (now U.S. Patent Publication No. 2007/0280624);

(5) U.S. Patent Application No. 60/802,697, filed on May 23, 2006, entitled "Lighting Device and Method of Making" (inventor: Gerald H. Negley), the entirety of which is hereby incorporated by reference, and U.S. patent application Ser. No. 11/751,990, filed May 22, 2007 (now U.S. Patent Publication No. 2007/0274063);

(6) U.S. Patent Application No. 60/839,453, filed on Aug. 23, 2006, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and (8) U.S. Patent Application No. 60/851,230, filed on Oct. 12, 2006, entitled "LIGHTING DEVICE AND METHOD OF MAKING SAME" (inventor: Gerald H. Negley, the entirety of which is hereby incorporated by reference.

Some embodiments according to the present invention include lighting devices which include at least a first LED and at least a first lumiphor. In some such embodiments, the light emitted from the first LED has a peak wavelength in a range of from 430 nm to 480 nm, and the light emitted from the first lumiphor has a dominant wavelength in a range of from about 555 nm to about 585 nm.

Some embodiments according to the present invention include lighting devices which include at least a first LED, at least a first lumiphor and at least a second LED. In some such embodiments, the light emitted from the first LED has a peak wavelength in a range of from 430 nm to 480 nm, and the light emitted from the first lumiphor has a dominant wavelength in a range of from about 555 nm to about 585 nm, and the light emitted from the second LED has a dominant wavelength in a range of from 600 nm to 630 nm.

Some embodiments according to the present invention include lighting devices which include at least a first solid state light emitter (which, in some such embodiments includes at least a first LED and at least a first lumiphor) which, if illuminated, emits light which has x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

In general, light of any number of colors can be mixed by the lighting devices according to the present invention. Representative examples of blends of light colors are described in:

(1) U.S. Patent Application No. 60/752,555, filed Dec. 21, 2005, entitled "Lighting Device and Lighting Method" (inventors: Antony Paul Van de Ven and Gerald H. Negley), the entirety of which is hereby incorporated by reference, and U.S. patent application Ser. No. 11/613,714, filed Dec. 20, 2006 (now U.S. Patent Publication No. 2007/0139920);

(2) U.S. Patent Application No. 60/752,556, filed on Dec. 21, 2005, entitled "SIGN AND METHOD FOR LIGHTING" (inventors: Gerald H. Negley and Antony Paul van de Ven), the entirety of which is hereby incorporated by reference, and U.S. patent application Ser. No. 11/613,733, filed Dec. 20, 2006 (now U.S. Patent Publication No. 2007/0137074);

(3) U.S. Patent Application No. 60/793,524, filed on Apr. 20, 2006, entitled "LIGHTING DEVICE AND LIGHTING METHOD" (inventors: Gerald H. Negley and Antony Paul van de Ven), the entirety of which is hereby incorporated by reference, and U.S. patent application Ser. No. 11/736,761, filed Apr. 18, 2007 (now U.S. Patent Publication No. 2007/0278934);

(4) U.S. Patent Application No. 60/793,518, filed on Apr. 20, 2006, entitled "LIGHTING DEVICE AND LIGHTING METHOD" (inventors: Gerald H. Negley and Antony Paul van de Ven), the entirety of which is hereby incorporated by reference, and U.S. patent application Ser. No. 11/736,799, filed Apr. 18, 2007 (now U.S. Patent Publication No. 2007/0267983);

(5) U.S. Patent Application No. 60/793,530, filed on Apr. 20, 2006, entitled "LIGHTING DEVICE AND LIGHTING METHOD" (inventors: Gerald H. Negley and Antony Paul van de Ven), the entirety of which is hereby incorporated by reference, and U.S. patent application Ser. No. 11/737,321, filed Apr. 19, 2007 (now U.S. Patent Publication No. 2007/0278503);

(6) U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference;

(8) U.S. Patent Application No. 60/868,986, filed on Dec. 7, 2006, entitled "LIGHTING DEVICE AND LIGHTING METHOD" (inventors: Antony Paul van de Ven and Gerald H. Negley), the entirety of which is hereby incorporated by reference;

(9) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and

(10) U.S. Patent Application No. 60/891,148, filed on Feb. 22, 2007, entitled "LIGHTING DEVICE AND METHODS OF LIGHTING, LIGHT FILTERS AND METHODS OF FILTERING LIGHT" (inventor: Antony Paul van de Ven, the entirety of which is hereby incorporated by reference.

As indicated above, some embodiments of the lighting devices according to the present invention can include lumiphors (i.e., luminescence region or luminescent element which comprises at least one luminescent material). The expression "lumiphor", as used herein, refers to any luminescent element, i.e., any element which includes a luminescent material.

A wide variety of luminescent materials (also known as lumiphors or luminophoric media, e.g., as disclosed in U.S.

Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear or translucent encapsulant material (e.g., epoxy-based, silicone-based, glass-based or metal oxide-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

The casing can be formed of any suitable material, a wide variety of which are well-known and readily available to persons skilled in the art. Suitable examples include materials through which light emitted by the light emitter(s) can pass through with minimal loss, i.e., materials which are highly transparent or translucent, such as glass and plastic materials. The casing can be of any desired shape, a wide variety of which are well-known to those skilled in the art. The present invention includes embodiments in which the casing and any other structure surrounding the light emitter(s) are of an overall shape and size which corresponds to a conventional shape and size of a lighting device (e.g., cone-shaped, bulb-shaped, tube-shaped, candle flame-shaped, etc.), i.e., the profile of the casing and any other structure surrounding the light emitter(s) corresponds to the profile of a conventional lighting device (and in some cases, the casing and any other structure surrounding the light emitter(s) are of an appearance which corresponds to the appearance of a conventional lighting device).

In some embodiments according to the present invention, the lighting device includes a connector portion. The connector portion can generally be any desired type of connector, e.g., a screw-threaded end (for example, which fits into an Edison socket), a rotatably engaging element (e.g., a GU-24 "twist and lock" socket), or any other suitable type (e.g., straight pins). In some such embodiments, the connector portion and the casing together completely surround the light emitter, i.e., as with a conventional incandescent light bulb. In such embodiments, the connector portion can be made of any suitable material (e.g., steel or aluminum). In some such embodiments, the connector portion is a screw-threaded end, which is receivable in a correspondingly threaded standard socket. In some such embodiments, the entire screw-threaded end is electrically conductive.

In some embodiments according to the present invention, the lighting device includes a connector portion which includes at least one contact. In such embodiments, the contact can be made of any suitable material (e.g., steel or aluminum), and is preferably insulated from the remainder of the connector portion.

In some embodiments, a screw-threaded end and a contact are provided, and they correspond to like components on conventional light bulbs.

In some embodiments, the lighting device includes a casing and two ends, the casing and the ends corresponding to like components on conventional fluorescent light bulbs.

The housing can be any desired shape, and can be made of any suitable material or materials. A wide variety of suitable housings, and materials (e.g., sheet metal, which is a good thermal conductor) for making suitable housings, are well-known and readily available to persons of skill in the art.

A socket can be attached to and supported by the housing. As is well-known, the socket can be constructed to be able to receive a portion of a lighting device, e.g., a screw-threaded end, to hold the lighting device in place relative to the housing, and the socket can provide electrical power to the lighting device via the connector portion (e.g., the screw-threaded end). Persons of skill in the art are familiar with and have access to a wide variety of sockets, any of which is suitable for use in the present invention.

The lighting devices can be supplied with electricity in any desired manner. Skilled artisans are familiar with a wide variety of power supplying apparatuses and fixtures, and any such apparatuses and fixtures can be employed in connection with the present invention. The lighting devices of the present invention can be electrically connected (or selectively connected) to any desired power source, persons of skill in the art being familiar with a variety of such power sources. In some lighting devices according to the present invention, electrical power is supplied to the lighting devices via conventional sockets, as is well-known in the art.

The heat transfer component (or components) can be made of any suitable material, and can be of any suitable shape, so long as it (or they) is effective for increasing the rate of heat transfer from the casing to the housing (relative to if no heat transfer component were provided) when the lighting device is mounted relative to the housing.

For example, in some embodiments, the heat transfer component comprises a thermally conductive filling composition positioned between and in contact with a portion of the casing and a portion of the housing. Any suitable composition can be used to make the heat transfer component of such embodiments, and skilled artisans are familiar with and have access to a wide variety of such suitable compositions. A representative example of a suitable material for use as the filling composition is a silicone rubber material (which can optionally include one or more additional materials, e.g., particles of SiC and graphite can be embedded in the silicone). In some embodiments, the filling composition is deformable. The filling composition can be placed in contact with the casing and the housing at any stage of manufacture, e.g., the filling composition can be pre-formed and placed in contact with the casing (and then the housing can be positioned relative to the filling composition), the filling composition can be pre-formed and placed in contact with the housing (and then the casing can be positioned relative to the filling composition), the filling composition can be pre-formed and the casing can be positioned relative to the housing and then the filling composition can be positioned relative to the housing and the casing, the filling composition can be formed while in contact with the housing (and then the casing can be positioned relative to the filling composition), the filling composition can be formed while in contact with the casing (and then the housing can be positioned relative to the filling composition), or the casing can be positioned relative to the housing and then the filling composition can be formed in position relative to the housing and the casing.

Some embodiments of the present invention include a deformable heat transfer component that will expand on installation and/or operation, e.g., as a result of a temperature increase, such that a portion of the heat generated by the lighting device (e.g., a LED bulb) is transferred from the lighting device to the fixture housing via the heat transfer component.

In some embodiments, the heat transfer component comprises a plurality of metal springs which partially or completely fill the gap (or one of the gaps) between the lighting device and the housing. Such springs can be made of any suitable material, a wide variety of which are well-known and readily available to persons skilled in the art. Representative examples of suitable materials for making the springs include, e.g., metals or compressible material such as silicon rubber, into which can optionally be embedded particles of high thermal conductive material such as SiC or graphite. In some such embodiments, such springs are made of beryllium-copper (or any other suitable material, e.g., steel) which has good thermal conductivity and also good elasticity. In some such embodiments, the springs are held close to the casing of the lighting device during installation with a clamp or retaining string, which clamp or retaining string can be removed after installation to allow the springs to expand out and come into contact with the housing, or, alternatively the springs are glue held closed with a heat sensitive adhesive, such that once the lamp is turned on and generates heat, the glue "breaks" and the springs expend outward to come into contact with the housing, i.e., either (1) the heat transfer component is in contact with the casing and is spring-loaded and restrained by a restraint, such that upon removal of the restraint, a portion of the heat transfer component moves into contact with the housing, or (2) the heat transfer component is in contact with the housing and is spring-loaded and restrained by a restraint, such that upon removal of the restraint, a portion of the heat transfer component moves into contact with the casing. In such embodiments, the springs may be of any desired size, e.g., 10-20 mm in diameter, or they may comprise very fine hairs. In some embodiments, the springs may be made of a bi-metallic material that changes shape when it is hot, and therefore allows the light bulb to be easily inserted or removed when it is cool and the springs to expand out and form the thermal path when it is warm.

In some embodiments according to the present invention, one or more heat transfer components move into a position where it (or they) is in contact with the casing and the housing upon being heated up to a heat transfer component activation temperature. In some of such embodiments, the heat transfer component activation temperature is at least 30 degrees C. In some of such embodiments, the heat transfer component activation temperature is at least 40 degrees C. In some of such embodiments, the heat transfer component activation temperature is at least 50 degrees C. In some of such embodiments, the heat transfer component activation temperature is at least 60 degrees C. In some of such embodiments, the heat transfer component activation temperature is at least 70 degrees C.

The heat transfer component can be in one piece, or, if desired, can be in two or more pieces, e.g., a first piece in contact with the housing (and not attached to or in contact with the casing) and a second piece in contact with the casing (and not attached to or in contact with the housing), with the first and second pieces being in thermal contact with each other—in such embodiments, the first piece can be thought of as being part of the housing (such that the second piece is a heat transfer component having a first portion in contact with a portion of the housing and having a second portion in contact with a portion of the casing), or the second piece can be thought of as being part of the casing (such that the first piece is a heat transfer component having a first portion in contact with a portion of the housing and having a second portion in contact with a portion of the casing).

The expression "lighting device", as used herein, is not limited, except that it is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present invention further relates to an illuminated enclosure (the volume of which can be illuminated uniformly or non-uniformly), comprising an enclosed space and at least one lighting device according to the present invention, wherein the lighting device illuminates at least a portion of the enclosure (uniformly or non-uniformly).

The present invention is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

As indicated above, various aspects of the present invention relate to lighting devices which comprise a casing and at least one light emitter at least partially enclosed within the casing. The expression "at least partially enclosed", as used herein in this context, indicates that the casing completely surrounds the one or more light emitter (such that any light originating in the one or more light emitter and escaping from the lighting device must pass through the casing), or that the casing only partially encloses the one or more light emitter, such that the casing does not completely enclose the space in which the one or more light emitter is positioned, and (1) the casing plus one or more other structures (which are in contact with the casing and/or each other) completely enclose the space in which the one or more light emitter is positioned, (2) the casing is in contact with one or more other structures, but the casing plus such other structures (and any additional structures which are in contact with such other structures) do not completely enclose the space in which the one or more light emitter is positioned, or (3) the casing is not in contact with any other structures. For example, a conventional incandescent light bulb or a conventional fluorescent light bulb each have a casing (typically made of glass or plastic) which does not completely enclose the space in which the filament (in an incandescent light bulb) or the mercury (in a fluorescent light bulb) is contained—these bulbs include one or two end portion structures which, together with the casings, completely enclose the space in which the filament or the mercury is contained.

The present invention is applicable to lighting devices of any desired shape and size, for use in any kind of fixture, 2' or 4' long light bulb fluorescent fixtures, bedside and desk lamps, all types of down lights, street lights, etc.

One or more brightness enhancement films can optionally further be included in the lighting devices. Such films are well-known in the art and are readily available. Brightness enhancement films (e.g., BEF films commercially available from 3M) are optional—when employed, they provide a more directional light source by limiting the acceptance angle. Light not "accepted" is recycled by the highly reflective light source enclosure. Preferably, the brightness enhancement films (which can optionally be replaced by one or more extraction films, such as by WFT), if employed, are optimized to limit the viewing angle of the emitted source and to increase the probability of extracting light on the first (or earliest possible) pass.

In addition, one or more scattering elements (e.g., layers) can optionally be included in the lighting devices. The scattering element(s) can be included in a lumiphor, and/or a separate scattering element can be provided. A wide variety of separate scattering elements and combined luminescent and scattering elements are well known to those of skill in the art, and any such elements can be employed in the lighting devices of the present invention.

The devices according to the present invention can further comprise secondary optics to further change the projected nature of the emitted light. Such secondary optics are well-known to those skilled in the art, and so they do not need to be described in detail herein—any such secondary optics can, if desired, be employed.

The devices according to the present invention can further comprise sensors or charging devices or cameras, etc. For example, persons of skill in the art are familiar with, and have ready access to, devices which detect one or more occurrence (e.g., motion detectors, which detect motion of an object or person), and which, in response to such detection, trigger illumination of a light, activation of a security camera, etc. As a representative example, a device according to the present invention can include a lighting device according to the present invention and a motion sensor, and can be constructed such that (1) while the light is illuminated, if the motion sensor detects movement, a security camera is activated to record visual data at or around the location of the detected motion, or (2) if the motion sensor detects movement, the light is illuminated to light the region near the location of the detected motion and the security camera is activated to record visual data at or around the location of the detected motion, etc.

In one embodiment according to the present invention, there is provided a light bulb that has an outer profile similar to a standard light bulb, so that it can be fitted into existing light fixtures, that includes a deformable thermally conducting means that will expand on installation and/or operation such that the heat generated by the LED light bulb is conducted through the deformable thermally conductive means to the light fixture housing, increasing the amount of heat that can be dissipated away from the LEDs and enabling LED light bulbs of comparable brightness to incandescent or fluorescent to be installed in pre-existing and standard light fixtures.

Figure 4:
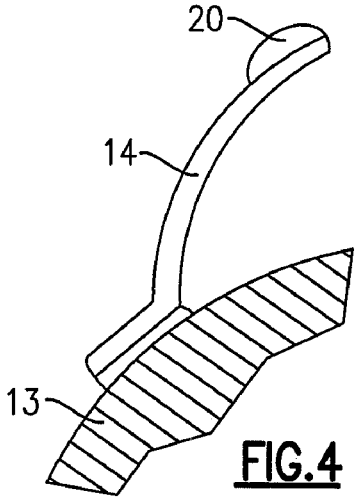

FIGS. 1-4 depict another embodiment according to the present invention. Referring to FIGS. 1-4, there is shown a lighting assembly 10 including a housing 11, a socket 12 mounted on the housing 11, a lighting device 13 and a plurality of heat transfer components 14. The lighting device 13 is a LED light bulb, and it includes a plurality of LEDs 15, a casing 16 and a screw-threaded end 17. The screw-threaded end 17 includes a contact 18. A power cord 19 provides power to the lighting device 13. The heat transfer components 14 are in the form of leaf springs. As shown in FIG. 4, each of the heat transfer components 14 includes a deformable heat coupling 20 which, when heated to a high enough temperature, contacts the housing 11.

Figure 5:
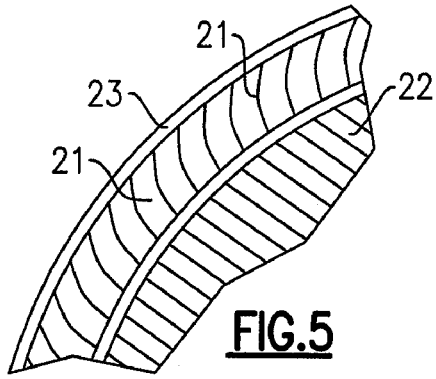
FIG. 5 depicts another embodiment of a lighting assembly according to the present invention.

FIG. 5 depicts another embodiment according to the present invention. This embodiment is similar to the embodiment depicted in FIGS. 1-4, except that in this embodiment, instead of the heat transfer components 14, there are provided a plurality of metal hairs 21 positioned between a lighting device 22 (which is a LED light bulb) and a housing 23.

Figure 6:
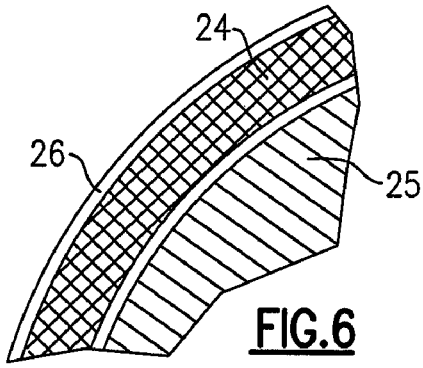
FIG. 6 depicts another embodiment of a lighting assembly according to the present invention.

FIG. 6 depicts another embodiment according to the present invention. This embodiment is similar to the embodiment depicted in FIGS. 1-4, except that in this embodiment, instead of the heat transfer components 14, there is provided a region of highly thermally conductive silicone material 24 positioned between a lighting device 25 (which is a LED light bulb) and a housing 26.

Figure 7:
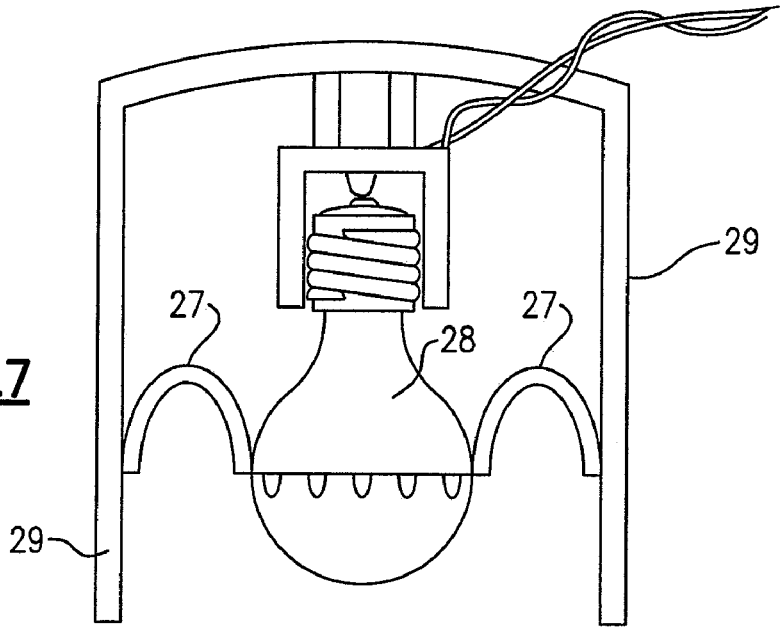
FIGS. 7 and 8 depict another embodiment of a lighting assembly according to the present invention.
Figure 8:
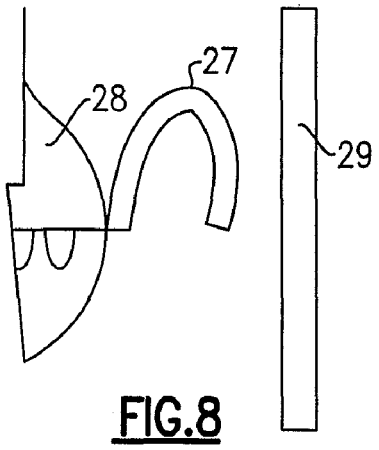

FIGS. 7 and 8 depict another embodiment according to the present invention. This embodiment is similar to the embodiment depicted in FIGS. 1-4, except that in this embodiment, instead of the heat transfer components 14, there is provided a plurality of thermal springs 27 positioned between a lighting device 28 (which is a LED light bulb) and a housing 29. The thermal springs 27 are retracted during shipment and installation (see FIG. 8), and they expand (due to heat emanating from the LED light bulb) during operation such that they come into contact with the housing 29 (see FIG. 7).

Figure 9:
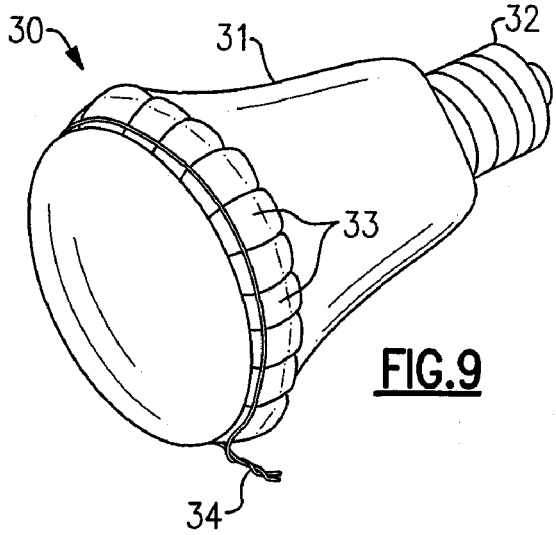
FIG. 9 depicts an embodiment of a lighting device according to the present invention.

FIG. 9 depicts another embodiment according to the present invention. Referring to FIG. 9, there is shown a lighting device 30 which is an LED light bulb, and which includes a plurality of LEDs (not shown), a casing 31, a screw-threaded end 32 and a plurality of heat transfer components 33. The heat transfer components 33 are springs and are shown in a retracted position, being held in the retracted position by a draw string 34 (i.e., a retaining string) which, when removed or released, allows the springs to expand into contact with a housing in which the lighting device 30 is mounted (by screw-threading the screw-threaded end 32 into a socket mounted on a fixture which includes the housing.

Figure 10:
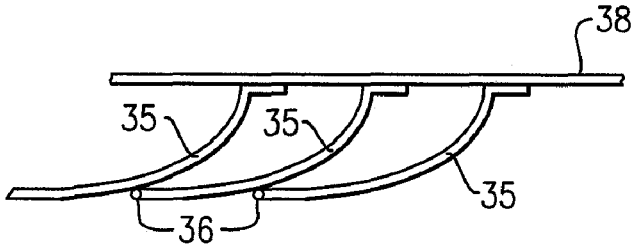
FIGS. 10 and 11 depict a plurality of heat transfer components in the form of springs which are held by glue beads in a retracted position (FIG. 10) and in which, during operation, the heat from the lighting device breaks the glue beads such that the springs expand into contact with a housing (FIG. 11).
Figure 11:
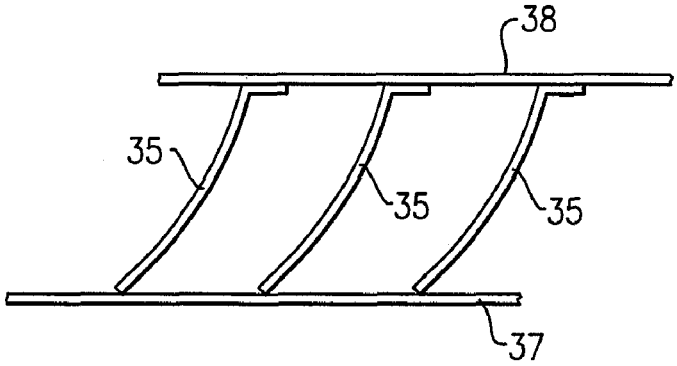

FIG. 10 depicts a portion of a lighting device 38 to which are attached a plurality of heat transfer components 35 in the form of springs which are held by glue beads 36 in a retracted position. During operation, the heat from the lighting device breaks the glue beads 36 such that the springs expand into contact with a housing 37 (see FIG. 11).

The present invention also provides methods, as noted above. Some embodiments according to the present invention comprise positioning a socket-engaging portion of a lighting device (as described herein) in a socket of a fixture (as described herein), such that at least a first portion of the heat transfer component is in contact with one of the casing and the housing, and then causing at least a second portion of the heat transfer component to move into contact with the other of the casing and the housing. Some embodiments according to the present invention comprise positioning a socket-engaging portion of a lighting device (as described herein) in a socket of a fixture (as described herein), and then positioning a heat transfer component such that at least a first portion of the heat transfer component is in contact with a first portion of the casing and at least a second portion of the heat transfer component is in contact with the housing.

Any two or more structural parts of the lighting devices described herein can be integrated. Any structural part of the lighting devices described herein can be provided in two or more parts (which are held together, if necessary). Similarly, any two or more functions can be conducted simultaneously, and/or any function can be conducted in a series of steps.

Furthermore, while certain embodiments of the present invention have been illustrated with reference to specific combinations of elements, various other combinations may also be provided without departing from the teachings of the present invention. Thus, the present invention should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the invention. Therefore, it must be understood that the illustrated embodiments have been set forth only for the purposes of example, and that it should not be taken as limiting the invention as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

The invention claimed is:

1. A lighting device, comprising:

a connector portion, at least a portion of said connector portion being electrically conductive;

at least a first light emitter;

a casing, said casing at least partially enclosing said first light emitter;

at least one heat transfer component, at least a first portion of said heat transfer component being in contact with a first portion of said casing, said first portion of said casing being spaced from an axis of said connector portion by a first distance, at least a second portion of said heat transfer component being spaced from said axis of said connector portion by a second distance, said second distance being greater than said first distance.

2. A lighting device as recited in claim 1, wherein said second portion of said heat transfer component moves farther away from said casing upon being heated up to a heat transfer component activation temperature.

3. A lighting device as recited in claim 1, wherein said heat transfer component is spring-loaded and restrained by a restraint, such that upon removal of said restraint, said second portion of said heat transfer component moves farther away from said casing.

4. A lighting device as recited in claim 1, wherein said heat transfer component comprises at least one multi-material structure.

5. A lighting device as recited in claim 1, wherein said casing has an outer profile which is substantially similar to an outer profile of a standard lighting device.

6. A lighting device as recited in claim 1, wherein said connector portion comprises at least one contact, at least a portion of said contact being electrically conductive.

7. A lighting device as recited in claim 1, wherein said light emitter comprises a solid state light emitter.

8. A fixture for a lighting device, comprising:

a housing;

a socket, said housing supporting said socket;

at least one heat transfer component, at least a first portion of said heat transfer component being spaced from an axis of said socket by a first distance, at least a second portion of said heat transfer component being in contact with a first portion of said housing, said first portion of said housing being spaced from said axis of said socket by a second distance, said second distance being greater than said first distance, whereby a lighting device can be engaged with said socket with said first portion of said heat transfer component in contact with said lighting device.

9. A fixture as recited in claim 8, wherein said first portion of said heat transfer component moves farther away from said housing upon being heated up to a heat transfer component activation temperature.

10. A fixture as recited in claim 8, wherein said heat transfer component is spring-loaded and restrained by a restraint, such that upon removal of said restraint, said first portion of said heat transfer component moves farther away from said housing.

11. A fixture as recited in claim 8, wherein said heat transfer component comprises at least one multi-material structure.

12. A lighting assembly, comprising:

a housing;

a socket, said housing supporting said socket;

at least one heat transfer component; and a lighting device comprising:

at least a first light emitter; and a casing, said casing at least partially enclosing said first light emitter, at least a first portion of said heat transfer component being in contact with a first portion of said casing, at least a second portion of said heat transfer component being in contact with a first portion of said housing.

13. A lighting assembly as recited in claim 12, wherein said heat transfer component comprises at least one silicone rubber compound.

14. A lighting assembly as recited in claim 13, wherein said heat transfer component further comprises particles of at least one material selected from the group consisting of SiC and graphite, said particles being embedded in said silicone rubber compound.

15. A lighting assembly as recited in claim 12, wherein said casing has an outer profile which is substantially similar to an outer profile of a standard lighting device.

16. A lighting assembly as recited in claim 12, wherein said lighting device comprises a connector portion, at least a portion of said connector portion being electrically conductive, said connector portion comprising at least one contact, at least a portion of said contact being electrically conductive, said connector portion being mounted in said socket, said first portion of said heat transfer component being attached to said first portion of said casing, said first portion of said casing being spaced from an axis of said connector portion by a first distance, said first portion of said housing being spaced from said axis of said connector portion by a second distance, said second distance being greater than said first distance.

17. A lighting assembly as recited in claim 16, wherein said second portion of said heat transfer component moves farther away from said casing upon being heated up to a heat transfer component activation temperature.

18. A lighting assembly as recited in claim 16, wherein said heat transfer component is spring-loaded and restrained by a restraint, such that upon removal of said restraint, said second portion of said heat transfer component moves farther away from said casing.

19. A lighting assembly as recited in claim 16, wherein said heat transfer component comprises at least one multi-material structure.

20. A lighting assembly as recited in claim 16, wherein said casing has an outer profile which is substantially similar to an outer profile of a standard lighting device.

21. A lighting assembly as recited in claim 12, wherein said lighting device comprises a connector portion, at least a portion of said connector portion being electrically conductive, said connector portion comprising at least one contact, at least a portion of said contact being electrically conductive, said connector portion being mounted in said socket, said first portion of said casing being spaced from an axis of said connector portion by a first distance, said second portion of said heat transfer component being attached to said first portion of said housing, said first portion of said housing being spaced from said axis of said connector portion by a second distance, said second distance being greater than said first distance.

22. A lighting assembly as recited in claim 21, wherein said first portion of said heat transfer component moves farther away from said housing upon being heated up to a heat transfer component activation temperature.

23. A lighting assembly as recited in claim 21, wherein said casing has an outer profile which is substantially similar to an outer profile of a standard lighting device.

24. A lighting device, comprising:

a connector portion, at least a portion of said connector portion being electrically conductive;

at least a first light emitter;

a casing, said casing at least partially enclosing said first light emitter; and means for transferring heat away from said casing.

25. A fixture for a lighting device, comprising:

a housing;

means for holding at least a first light emitter in place relative to said housing; and means for transferring heat from a light emitter mounted in said means for holding a first light emitter relative to said housing.

26. A method of deploying a lighting device, comprising:

connecting into a socket of a fixture a connector portion of a lighting device, said fixture comprising a housing, said lighting device comprising said connector portion, at least a first light emitter, a casing, and at least one heat transfer component, at least a portion of said connector portion being electrically conductive, said casing at least partially enclosing said first light emitter, at least a first portion of said heat transfer component being in contact with a first portion of said casing, and then causing at least a second portion of said heat transfer component to move into contact with said housing.

27. A method of deploying a lighting device, comprising:

connecting into a socket of a fixture a connector portion of a lighting device, said fixture comprising a housing and at least one heat transfer component, said lighting device comprising said connector portion, at least a first light emitter and a casing, at least a portion of said connector portion being electrically conductive, said casing at least partially enclosing said first light emitter, at least a first portion of said heat transfer component being in contact with said housing, and then causing at least a second portion of said heat transfer component to move into contact with said casing.

28. A method of deploying a lighting device, comprising:

connecting into a socket of a fixture a connector portion of a lighting device, said fixture comprising a housing, said lighting device comprising said connector portion, at least a first light emitter and a casing, at least a portion of said connector portion being electrically conductive, said casing at least partially enclosing said first light emitter, and then positioning a heat transfer component such that at least a first portion of said heat transfer component is in contact with a first portion of said casing and at least a second portion of said heat transfer component is in contact with said housing.

* * * * *

UNITED STATES PATENT AND TRADEMARK OFFICE

CERTIFICATE OF CORRECTION

PATENT NO. : 7,959,329 B2
APPLICATION NO. : 11/856421
DATED : June 14, 2011
INVENTOR(S) : Antony Paul Van De Ven It is certified that error appears in the above-identified patent and that said Letters Patent is hereby corrected as shown below:

Title Page, Item (56), References Cited, Foreign Patent Documents:

*please change* "WO 2008079161 7/2004" to --WO 2008079161 7/2008--

Signed and Sealed this
Thirteenth Day of September, 2011

David J. Kappos

David J. Kappos
*Director of the United States Patent and Trademark Office*